United States Patent [19]

Drohomirecky et al.

[11] 4,083,563

[45] Apr. 11, 1978

[54] FORTUNE POUCH GAME

[76] Inventors: Walter Drohomirecky; Sandy Lynn Drohomirecky, both of 164 Fifth St., Rankin, Pa. 15104

[21] Appl. No.: 747,944

[22] Filed: Dec. 7, 1976

[51] Int. Cl.[2] ..... A63F 9/04; A63H 33/16

[52] U.S. Cl. ..... 273/139; 46/1 L; 273/155

[58] Field of Search ..... 273/155, 139, 161; 46/1 L, 37; 40/124.4

[56] References Cited

U.S. PATENT DOCUMENTS

| | | | |
|---|---|---|---|
| 502,896 | 8/1893 | Vine | 46/1 L |
| 847,545 | 3/1907 | Braine | 273/155 UX |
| 2,220,499 | 11/1940 | Thomas | 40/124.4 UX |
| 3,811,682 | 5/1974 | Neale et al. | 273/155 |
| 3,866,748 | 2/1975 | Manning | 46/1 L X |

*Primary Examiner*—Anton O. Oechsle
*Attorney, Agent, or Firm*—Leonard W. Suroff

[57] ABSTRACT

A game adapted to be held in the hands of a player for manipulation into specific positions, with the game comprising a body portion of a flexible material having an inner surface and an outer surface so as to be foldable between a flat plane and into a pair of panels, and each panel including oppositely disposed upper and lower ends and spaced apart sides intermediate the ends. The panels are flexibly connected to each other along the lower end and adapted to alter in configuration to the specific positions. A pair of flexible outer flaps are integrally formed with each of the panels on the outer surface with each outer flap being connected to the upper end and one of the sides, such that each outer flap has an inner end and a bottom end freely movable relative to its respective one of the panels so that the fingers of each hand of the player may be interposed between each of the panels and each of the flaps. A plurality of flexible inner flaps are integrally formed with the body portion and hingeably secured thereto and adapted to be disposed in a closed position in overlapping relationship with the body portion to an open position extending upwardly from the body portion, with each inner flap having a viewable outer surface and an inner surface, and a chance element are removably connected to each of the flexible inner flaps on each inner surface. First and second indicia on each of the inner flaps is provided on each viewable outer surface, and the first indicia is viewable when the panels are positioned in one position and the second indicia is viewable when the panels are positioned in another position by manipulation of the fingers of the player.

18 Claims, 8 Drawing Figures

BLUE
THREE
FOUR
RED
TWO
FIVE
ONE
SIX
GREEN
EIGHT
SEVEN
ORANGE

FORTUNE POUCH GAME

BACKGROUND OF THE INVENTION

The present invention relates to a game, and more particularly to a game that is adapted to be hand held and changed into different positions.

The game of the present invention provides the player with a chance to use his or her hands to alter the configuration of the game which is fabricated from a flexible material in order to assume different positions, during which the game is played.

OBJECTS OF THE INVENTION

An object of the present invention is to provide a game having chance means associated therewith, and the game adapted to be hand held and maneuverable by the hands of the user into differing positions.

Another object of the present invention is to provide a game having different indicia means thereon, certain of the indicia means being viewable in one position, and other of the indicia means being viewable in another position of the game.

Other objects and advantages of the present invention will become apparent as the disclosure proceeds.

SUMMARY OF THE INVENTION

A game adapted to be held in the hands of a player for manipulation into specific positions, with the game comprising a body portion of a flexible material having an inner surface and an outer surface so as to be foldable between a flat plane and into a pair of panels, and each panel including oppositely disposed upper and lower ends and spaced apart sides intermediate the ends. The panels are flexibly connected to each other along the lower end and adapted to alter in configuration to the specific positions.

A pair of flexible outer flaps are integrally formed with each of the panels on the outer surface, with each outer flap being connected to the upper end and one of the sides, such that each outer flap has an inner end and a bottom end freely movable relative to its respective one of the panels so that the fingers of each hand of the player may be interposed between each of the panels and each of the flaps.

A plurality of flexible inner flaps are integrally formed with the body portion and hingeably secured thereto and adapted to be disposed in a closed position in overlapping relationship with the body portion to an open position extending upwardly from the body portion, with each inner flap having a viewable outer surface and an inner surface, and chance means are removably connected to each of the flexible inner flaps on each inner surface.

First and second indicia means on each of the inner flaps are provided on each viewable outer surface, and the first indicia means are viewable when the panels are positioned in one position and the second indicia means being viewable when the panels are positioned in another position by manipulation of the fingers of the player.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figures 1, 2, 4, 5, 9, 10:
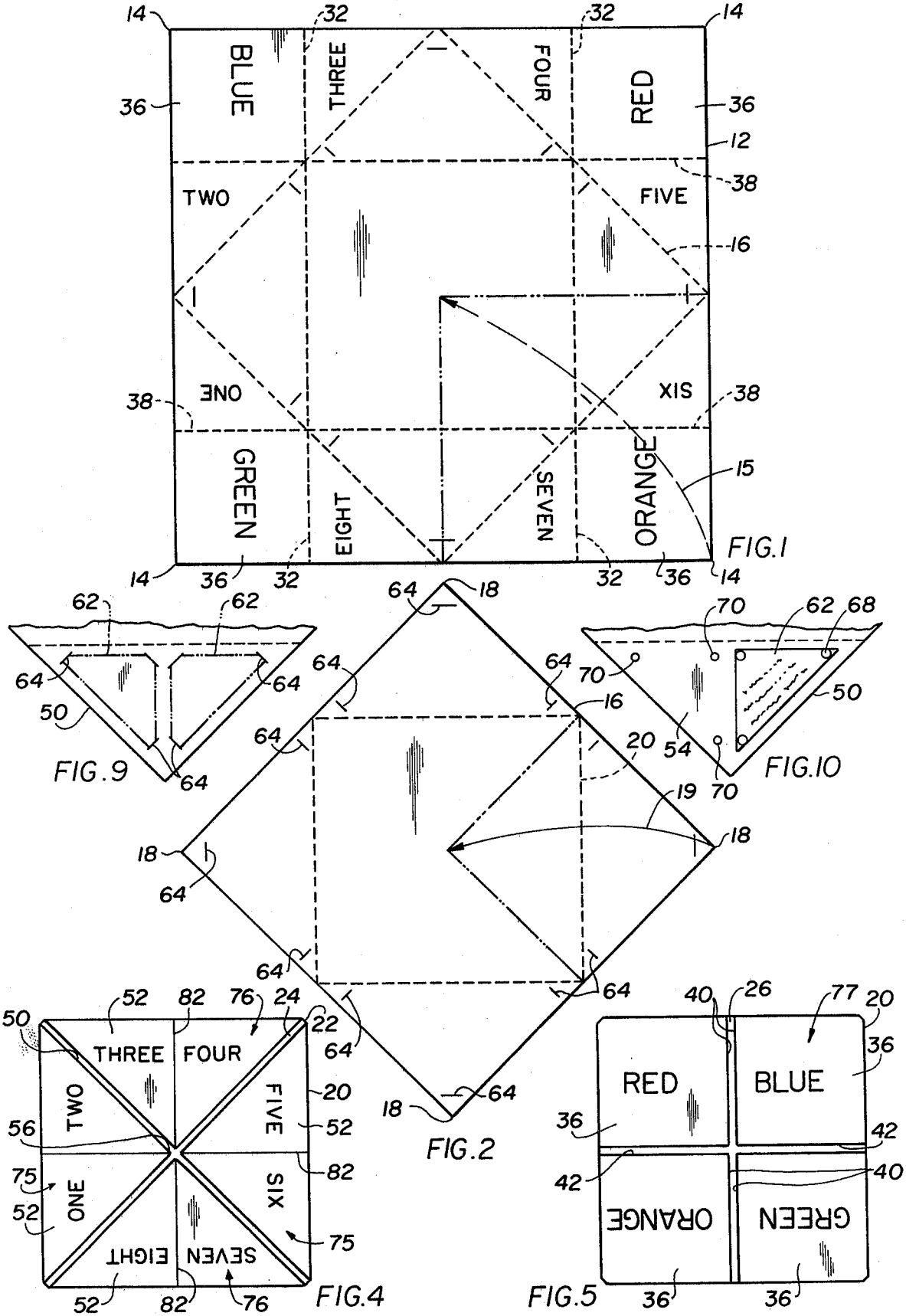
FIG. 1 is a plan view illustrating the sheet of material from which the game may be formed.
FIG. 2 is a plan view similar to FIG. 1 illustrating the fold-over portions in order to obtain a second rectangle.
FIG. 4 is a top plan view of the game in the unfolded position.
FIG. 5 is a bottom plan view of the game in the unfolded position.
FIG. 9 is a fragmentary plan view illustrating one manner of securing chance means to the game.
FIG. 10 is a view similar to FIG. 9 illustrating an alternate form of securing the chance means to the game.

Referring to the drawings, a preferred embodiment of the present invention is illustrated in FIGS. 1 through 10 of a game 10 that is adapted to be held in the hands of a player for manipulation into specific positions, as hereinafter described in detail.

The game 10 is formed of a foldable sheet 12, illustrated in FIG. 1, consisting of a rectangular sheet of material, which may be fabricated from plastic, or the like, having the four corners 14 of the sheet 12 being first folded backwardly, as indicated by arrow 15, to the center forming a second rectangle 16 of smaller dimensions. The second rectangle 16 is illustrated in FIG. 2. Then folding of the four corners 18 of the second rectangle sheet 16 inwardly to the center, as illustrated in FIG. 2, in the direction of arrow 19 forms a third rectangle 20 of still smaller dimensions. Accordingly, the fortune pouch game 10 may vary in size for both children and adults.

Figure 3:
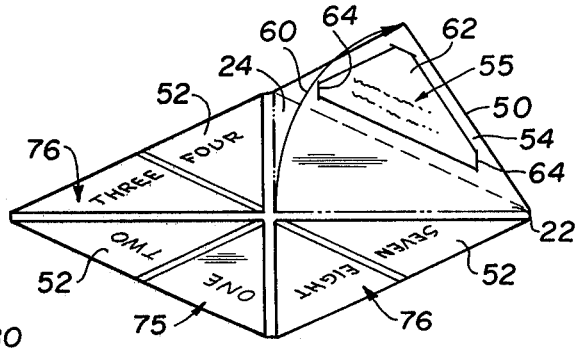
FIG. 3 is a perspective view illustrating the game after the folding of the sheet of material in accordance with FIGS. 1 and 2.

The third rectangle 20 forms a body portion 22 of the flexible material having an inner surface 24 and an outer surface 26 so as to be foldable between a flat plane, as illustrated in FIGS. 3–5, into a pair of panels 28 and 30. Each panel includes oppositely disposed upper and lower ends 32 and 34, respectively, and spaced apart sides 35 intermediate the ends. The panels 28 and 30 are flexibly connected to each other along the lower end 34 and adapted to alter in configuration to the specific position illustrated in FIGS. 6–8.

A pair of flexible outer flaps 36 are integrally formed with each of the panels 28 and 30 on the outer surface 26, with each outer flap 36 being connected to the upper end 32 and one of the sides 38, such that each outer flap 36 has an inner end 40 and a bottom end 42 freely movable relative to its respective one of the panels 28 and 30 so that the fingers 44 of each hand 45 of the player may be interposed between each of the panels 28 and 30 and each of the flaps 36.

The upper end 46 and the sides 38 extend around the body portion 22 such that the panels 28 and 30 may be moved into various positions. The outer flaps 36 extend in substantially the same plane as the lower end 34 of each of the panels 28 and 30. Each flap 36 therefore has an upper end 46 which extends loosely over the upper end 32 of each panel 28 and 30, such that it is capable of movement relative thereto in the various positions illustrated in FIGS. 6–8. The flaps 36 are formed by following the folding of the sheet 12 illustrated in FIG. 1. Accordingly, the folded position of the sheet 12 is in the form of a pouch, which configuration is readily altered by the player of the game.

The game 10 being formed in the manner set forth in FIGS. 1 and 2 develops the configuration such that the inner end 40 of the outer flaps 36 extend in vertically spaced relationship to each other, as clearly illustrated in FIG. 5. In a similar manner the bottom end 42 of each flap 36 also extend in substantially parallel spaced relationship to each other in the flat position of the game, as illustrated in FIG. 5.

The folding of the sheet 12 also produces a plurality of flexible inner flaps 50 that are integrally formed with the body portion 22 and hingeably secured thereto and adapted to be disposed in a closed position in overlapping relationship with the body portion 22 to an open position extending upwardly from the body portion 22, with each inner flap 50 having a viewable outer surface 52 and an inner surface 54, and chance means 55 being removably connected to each of the flexible inner flaps on each inner surface 54.

As illustrated in FIG. 4, each one of the inner flaps 50, four being illustrated, is in the form of a triangle of equal size. One corner 56 of each triangle disposed inwardly of one side of the body portion 22. Each inner flap 50, as illustrated by arrow 60, is readily moved to the open position, when the game 10 is lying flat. Accordingly, the last folded corners, as illustrated by arrow 19 in FIG. 2, form the flexible inner flaps 50 such that the corners 18 coincide with the inner pointed end 56 of each flap 50. The panels 28 and 30 extend intermediate the inner flaps 50 and outer flaps 36.

The chance means 55 may include cards or other elements 62 adapted to be removably secured by a plurality of slits or grooves 64 provided on each of the inner flaps 50. The slit 64 is dimensioned to receive the respective corners of the element 62 therein. Each element may have various indicia thereon, or even be in blank form to be filled out by the players of the game.

FIG. 9 illustrates that each inner flap 50 may include two sets of securing means in the form of the slits 64 such that two elements 62 may be provided in association with each inner flap 50. FIG. 10 illustrates a variation in which each element 62 may be secured by a fastener 68 that snaps into an aperture 70 provided within the inner surface 54 of the flap 50. Obviously, even adhesive means may be utilized as the securing means to obtain the desired retention during play of the game.

Each of the inner flaps 50 are provided with first indicia means 75 and second indicia means 76. The indicia means 75 and 76 are provided on the viewable outer surface 52. The first indicia means 75 are viewable when the panels 28 and 30 are positioned in one position and the second indicia means 76 are viewable when the panels 28 and 30 are positioned in another position by manipulation of the fingers 44 and thumbs 47 of the player.

As illustrated in FIG. 4, the first indicia means 75 is contained on oppositely disposed inner flaps 50 and include the indicia information ONE, TWO, on one flap 50 and FIVE, SIX, on another flap 50. The second indicia means 76 includes the information THREE, FOUR, on one flap 50 and SEVEN, EIGHT on another flap 50.

Obviously, the information set forth on the inner flaps 50 may vary and is not limited to any numbering sequence. In addition, third indicia means 77 is provided on each of the outer flaps 36. As illustrated in FIG. 5, the third indicia means 77 includes reference to the colors RED, BLUE, GREEN, and ORANGE.

Figure 6:
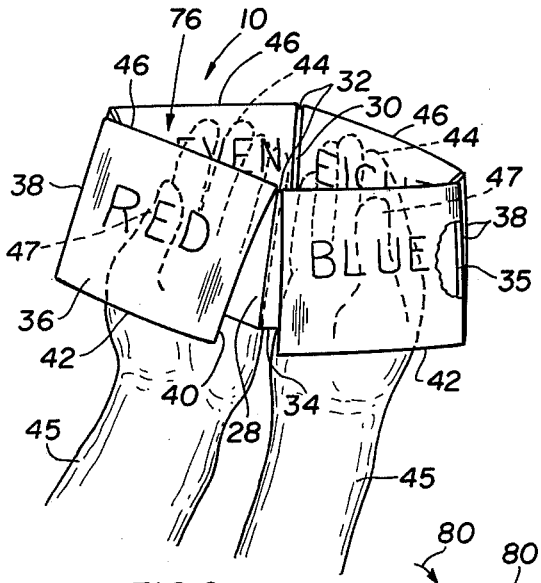
FIG. 6 is a perspective view of the game in its folded position being held by the hands of the player.
Figure 8:
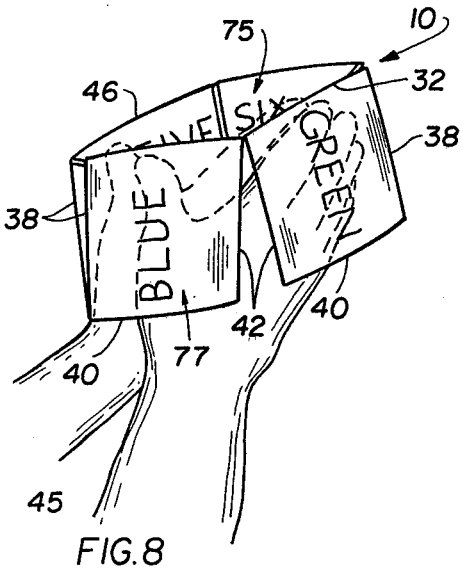
FIG. 8 is a perspective view with the game having changed its position.

The game 10 may be played in various ways, but particularly the position may vary such that either the first indicia means 75 is viewable in the position illustrated in FIG. 8, or the second indicia means 76 is viewable when the game 10 is held in the position illustrated in FIG. 6. As seen in FIG. 6, the fingers 44 of each hand are initially interposed between the outer flaps 36 and respective panels 28 or 30. The thumb 47 is placed between the other set of flaps 36 and the other panel 28, as illustrated in FIG. 6. In this position with the fingers 44 and thumbs 47 compressing slightly adjacent the ends 38, the second indicia means 76 will be viewable.

Figure 7:
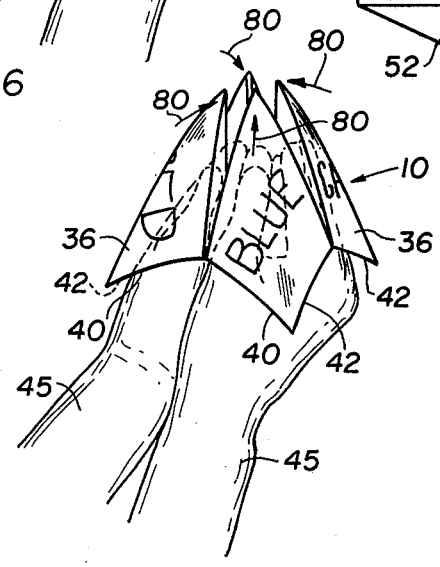
FIG. 7 is a perspective view illustrating the manner in which the change of position of the game occurs.

The transition step illustrated in FIG. 7 is accomplished by initially moving the respective thumb 47 and fingers 44 towards each other in the direction of arrows 80, such that the position illustrated in FIG. 8 is reached and the first indicia means 75 is viewable. As illustrated in FIG. 8, the hands 45 of the player are in a prayer position to obtain this arrangement. Movement from FIG. 6 to FIG. 8 is readily obtained by a user of the game. In addition movement from FIG. 8 to FIG. 6 is also easily obtained.

The rules of the game permit the player to maneuver the game such that looking down from the top you would see the written numbers of the first and second indicia means 75 and 76. The above steps illustrate the general movement of the pouch formed by the game 10 such that it can be used as a fortune pouch in conjunction with the chance means 55.

By providing two elements 62, as illustrated in FIGS. 9 and 10, each number may have its own particular element 62 associated therewith. If desired, a divisional line 82 may be provided on each of the inner flaps 50. Although the pouch game 10 has been illustrated as being fabricated from a single sheet of material, it is appreciated that it may be fabricated from multiple sheets or otherwise manufactured to accomplish the same desired end result. The fortune element 62 is removed when the pouch game 10 is in the position illustrated in FIG. 3.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A game adapted to be held in the hands of a player for manipulation into specific positions, said game comprising:

a. a body portion of a flexible material having an inner surface and an outer surface, said body portion being foldable between a flat plane and into a pair of panels, b. said panels each including oppositely disposed upper and lower ends and spaced apart sides intermediate said ends, said panels flexibly connected to each other along said lower end, c. a pair of flexible outer flaps integrally formed with each of said panels on said outer surface, each said outer flap being connected to said upper end and one of said sides, each said outer flap having an inner end and a bottom end freely movable relative to its respective one of said panels, such that the fingers of each hand of the player may be interposed between each of said panels and each of said flaps, d. a plurality of flexible inner flaps integrally formed with said body portion and hingeably secured thereto and adapted to be disposed in a closed position in overlapping relationship with said body portion to an open position extending upwardly from said body portion, e. each said inner flap having a viewable outer surface and an inner surface, f. chance means being removably connected to said flexible inner flaps on each said inner surface, g. securing means associated with each of said inner flaps for removably connecting said chance means thereto, h. said securing means includes a plurality of slits in each of said inner flaps, i. said chance means is in the form of a sheet element with corners thereof adapted to be received in each of said slits, j. first and second indicia means on each of said inner flaps on each said viewable outer surface, and k. said first indicia means being viewable when said panels are positioned in one position and said second indicia means being viewable when said panels are positioned in another position by manipulation of the fingers of the player.

2. A game as in claim 1, wherein said bottom end of each of said outer flaps extends in substantially the same plane as said lower end of each of said panels.

3. A game as in claim 1, wherein said inner end of each pair of said outer flaps extends in vertically spaced relationship to each other.

4. A game as in claim 1, wherein each one of said inner flaps is associated with one side of said body portion.

5. A game as in claim 4, wherein each one of said inner flaps is in the form of a triangle with one corner thereof disposed inwardly of one said side of said body portion.

6. A game as in claim 5, wherein each of said triangles forming said inner flaps is equal in size.

7. A game as in claim 1, wherein the game is formed of a foldable sheet consisting of a rectangular sheet of material, a. the four corners of said sheet being first folded backwardly to the center forming a second rectangle of smaller dimensions, and b. then folding the four corners of the second rectangle sheet inwardly to the center forming said body portion in the form of a third rectangle of still smaller dimensions, said last folded corners forming said flexible inner flaps on one side of said body portion and said panels on said other side of said body portion.

8. A game as in claim 1, wherein two sets of said slits are provided in each said inner flap so as to provide a pair of said chance means associated therewith.

9. A game as in claim 1, and third indicia means on each of said outer flaps.

10. A game as in claim 1, wherein each one of said flaps is of substantially equal size.

11. A game as in claim 1, wherein said flexible material is plastic.

12. A game adapted to be held in the hands of a player for manipulation into specific positions, said game comprising:

a. a body portion of a flexible material having an inner surface and an outer surface, said body portion being foldable between a flat plane and into a pair of panels, b. said panels each including oppositely disposed upper and lower ends and spaced apart sides intermediate said ends, said panels flexibly connected to each other along said lower end, c. a pair of flexible outer flaps integrally formed with each of said panels on said outer surface, each said outer flap being connected to said upper end and one of said sides, each said outer flap having an inner end and a bottom end freely movable relative to its respective one of said panels, such that the fingers of each hand of the player may be interposed between each of said panels and each of said flaps, d. a plurality of flexible inner flaps integrally formed with said body portion and hingeably secured thereto and adapted to be disposed in a closed position in overlapping relationship with said body portion to an open position extending upwardly from said body portion, e. each said inner flap having a viewable outer surface and an inner surface, f. chance means being removably connected to said flexible inner flaps on said inner surface, g. securing means associated with said inner flaps for removably connecting said chance means thereto, said securing means includes a plurality of slits in each of said inner flaps, and said chance means is in the form of a sheet element with corners thereof adapted to be received in each of said slits, h. first and second indicia means on each of said inner flaps on each said viewable outer surface, i. said first indicia means being viewable when said panels are positioned in one position and said second indicia means being viewable when said panels are positioned in another position by manipulation of the fingers of the player, and j. third indicia means on each of said outer panels.

13. A game as in claim 12, wherein each one of said inner flaps is in the form of a triangle with one corner thereof disposed inwardly of one said side of said body portion.

14. A game as in claim 13, wherein each of said triangles forming said inner flaps is equal in size.

15. A game as in claim 12, wherein the game is formed of a foldable sheet consisting of a rectangular sheet of material, a. the four corners of said sheet being first folded backwardly to the center forming a second rectangle of smaller dimensions, and b. then folding the four corners of the second rectangle sheet inwardly to the center forming said body portion in the form of a third rectangle of still smaller dimensions, said last folded corners forming said flexible inner flaps on one side of said body portion and said panels on said other side of said body portion.

16. A game as in claim 12, wherein two sets of said slits are provided in each said inner flap so as to provide a pair of said chance means associated therewith.

17. A game as in claim 12, wherein each one of said flaps is of substantially equal size.

18. A game as in claim 12, wherein said flexible material is plastic.

* * * * *